US012338541B2

(12) United States Patent
Litschko

(10) Patent No.: US 12,338,541 B2
(45) Date of Patent: Jun. 24, 2025

(54) ELECTROLYTE FOR ELECTROPOLISHING TITANIUM ALLOYS

(71) Applicant: BIOTRONIK AG, Bülach (CH)

(72) Inventor: Robert Litschko, Rostock (DE)

(73) Assignee: BIOTRONIK AG, Buelach (CH)

( * ) Notice: Subject to any disclaimer, the term of this patent is extended or adjusted under 35 U.S.C. 154(b) by 71 days.

(21) Appl. No.: 17/767,557

(22) PCT Filed: Nov. 10, 2020

(86) PCT No.: PCT/EP2020/081557
§ 371 (c)(1),
(2) Date: Apr. 8, 2022

(87) PCT Pub. No.: WO2021/115698
PCT Pub. Date: Jun. 17, 2021

(65) Prior Publication Data

US 2024/0102198 A1 Mar. 28, 2024

(30) Foreign Application Priority Data

Dec. 10, 2019 (EP) ..... 19214685

(51) Int. Cl.
*C25F 3/26* (2006.01)
*C25F 1/08* (2006.01)
*C25F 3/08* (2006.01)

(52) U.S. Cl.
CPC ..... *C25F 3/26* (2013.01); *C25F 1/08* (2013.01); *C25F 3/08* (2013.01)

(58) Field of Classification Search
USPC ..... 205/674, 675, 678
See application file for complete search history.

(56) References Cited

U.S. PATENT DOCUMENTS

2008/0067077 A1 3/2008 Kodera et al.
2008/0121530 A1* 5/2008 Piesslinger-Schweiger ..... C25F 3/16 205/684
2020/0080222 A1 3/2020 Hansal et al.

FOREIGN PATENT DOCUMENTS

CN 107460534 B 1/2019
EP 1354986 A2 10/2003

OTHER PUBLICATIONS

International Search Report and Written Opinion from the corresponding International Patent Application No. PCT/EP2020/081557, dated Jan. 13, 2021.
European Search Report from the corresponding European Patent Application No. 19214685, dated May 4, 2020.

* cited by examiner

*Primary Examiner* — Brian W Cohen
(74) *Attorney, Agent, or Firm* — Greer, Burns & Crain, Ltd.; Steven P. Fallon

(57) ABSTRACT

An electrolyte for electropolishing metal surfaces, in particular workpieces, in particular made of titanium or titanium alloys such as nitinol. The electrolyte composition includes methanesulfonic acid and more than one polyhydric alcohol. The content of methanesulfonic acid is less than 15 vol %, the polyhydric alcohols having at least one diol and at least one polyalcohol. The at least one diol accounts for 20 to 65 vol %, and the at least one polyalcohol accounts for 20 to 65 vol %

13 Claims, No Drawings

ELECTROLYTE FOR ELECTROPOLISHING TITANIUM ALLOYS

PRIORITY CLAIM

This application is a 35 U.S.C. 371 US National Phase and claims priority under 35 U.S.C. § 119, 35 U.S.C. 365(b) and all applicable statutes and treaties from prior PCT Application PCT/EP2020/081557, which was filed Nov. 10, 2020, which application claimed priority from European Application Serial Number 19214685.0, which was filed Dec. 10, 2019.

FIELD OF THE INVENTION

Fields of the invention include electrolytes and electropolishing. An electrolyte of the invention has application in the electropolishing of metal surfaces, in particular workpieces, in particular made of titanium or titanium alloys such as nitinol.

BACKGROUND

Electrochemical polishing is used to create high-purity metal surfaces, and to smooth and debur metal surfaces. Smoothing in the micro-range can also achieve shining of the surfaces thus treated. In addition, electropolishing is able to remove potential stresses in the outer material layers.

Known electrolytes in general have a strong mineral acid, such as sulfuric acid, trichloroacetic acid, phosphonic acid, or also amidosulfonic acid. Electrolytes that are based on these acids are problematic in terms of occupational health and safety due to the aggressive nature of the acid. One variant in which this drawback is less pronounced is a mixture of methanesulfonic acid and phosphonic acid. This variant, however, is very expensive.

EP 1923490 A2 describes an electrolyte system of methanesulfonic acid and an alcoholic component. The alcoholic component is an aliphatic diol of the general formula $C_nH_{2n}(OH)_2$, where n=2-6, and acyclic alcohols of the general formula $C_mH_{2m-1}OH$, where m=5-8. In described examples, the content of methanesulfonic acid is to be at least 20%. In general, the content of methanesulfonic acid can be as high as 95%. Such quantities are very problematic from an occupational health and safety perspective and require special handling and identification. A high content of methanesulfonic acid also results in high costs.

SUMMARY OF THE INVENTION

A preferred electrolyte of the invention is a cost-effective electrolyte that is consistent with goals of occupational health and safety. A preferred electrolyte is useful for electropolishing metal workpieces, in particular made of titanium or titanium alloys. The electrolyte has a low content of acid, which additionally can be produced cost-effectively. The present invention furthermore relates to a method for electropolishing, and to the use of the electrolyte for electropolishing metal workpieces.

An electrolyte is provided, comprising or consisting of the following components:

methanesulfonic acid; and more than one polyhydric alcohol.

The content of methanesulfonic acid is up to or less than 15 vol %. It is furthermore provided according to the invention that the polyhydric alcohols include at least one diol and at least one higher polyalcohol, wherein the at least one diol accounts for a content of 20 to 65 vol %, and the at least one polyalcohol accounts for a content of 20 to 65 vol %.

All components add up to 100 vol %.

DETAILED DESCRIPTION OF THE PREFERRED EMBODIMENTS

An electrolyte of the invention is not based on methanesulfonic acid serving as the solvent, but only includes a small fraction of the acid, while the polyhydric alcohols are present in large excess. In this way, immediate acid burns on body parts or surfaces can thus be avoided.

In a preferred embodiment of the electrolyte, methanesulfonic acid accounts for less than 10 vol %, and in particular 1 to 7 vol %. In a further embodiment, the electrolyte has a content of methanesulfonic acid of more than 1 vol % and less than 5 vol %. In the latter range, such an electrolyte no longer has to bear a "caustic" sign (according to European Union regulations), but only an exclamation mark. In a particularly preferred embodiment, the electrolyte has a content of methanesulfonic acid of more than 2.5 vol % and less than 5 vol %. Since methanesulfonic acid is only used as a partial component in a very low fraction, this electrolyte is superior to all others when it comes to costs, since very good results can also be achieved with concentrations of methanesulfonic acid of as little as 1 vol %. A higher content of methanesulfonic acid of up to 15% yields the advantage that the holding periods of the electrolytes can be kept high; however, due to the high price of methanesulfonic acid, such mixtures involve higher costs.

In addition, the electrolyte includes a diol in a content of 20 to 65 vol %. A diol can be an aliphatic diol of the general formula $C_nH_{2n}(OH)_2$, where n=2-5. In one embodiment, the diol is to account for a percentage by volume of 30 to 60 vol %. In a further embodiment, the diol is to account for a percentage by volume of 35 to 45 vol %. In a further embodiment, the diol is to account for a percentage by volume of more than 50 to 62.5 vol %. The diol can be selected from the group comprising or consisting of 1,2-propanediol, 1,3-propanediol, ethylene glycol, 1,2-butanediol, 1,3-butanediol, 1,4-butanediol, 2,3-butanediol, 1,2-pentanediol, 1,3-pentanediol, 1,4-pentanediol, 1,5-pentanediol, 2,3-pentanediol, 2,4-pentanediol. The diol is preferably selected from ethylene glycol, 1,4-butanediol, and 1,2-propanediol. The advantage of, in particular, the two latter diols is that these diols can be acquired as solvents inexpensively and without delivery difficulties. Furthermore, it is also possible to use predominantly liquid polymers of diols as "diols." In particular, lower, predominantly liquid polyethylene glycols (PEG) can be used, in particular up to PEG 600, such as PEG 200, PEG 300 or PEG 400.

In addition, the electrolyte includes a polyalcohol in a percentage by volume of 20 to 65 vol %. A polyalcohol herein is to be an alcohol comprising more than two OH groups, that is a higher polyalcohol than a diol. In one embodiment, the polyalcohol is to account for a percentage by volume of 30 to 60 vol %. In a further embodiment, the polyalcohol is to account for a percentage by volume of 35 to 45 vol %. In a further embodiment, the polyalcohol is to account for a percentage by volume of more than 50 to 62.5 vol %. The lowest polyalcohol is glycerol, but it is also possible to use the higher polyalcohols including a linear C4 to C8 carbon chain. The polyalcohol can furthermore be selected from one of the following triols: 1,2,3-butanetriol, 1,2,4-butanetriol, 1,2,5-pentanetriol, 1,3,4-pentanetriol, 1,3, 5-pentanetriol. In one embodiment, the polyalcohol is selected from the group of triols including a linear C3 to C5 carbon chain.

The advantage of polyalcohol, and in particular of glycerol, is that the electrolyte takes on a higher viscosity. The increased viscosity results in the formation of a stable electrochemical interface on the workpiece surface. This causes the process, which otherwise is controlled by the local current density (the local current density is dependent, among other things, on the distance with respect to the cathode), to become a diffusion-controlled process. The described process, in any location of the workpiece to be treated, can accordingly not become faster than the diffusion rate of the metal ions through the electrochemical interface. As a consequence, interfaces are obtained that are free of defects. This means that electropolishing of the highest quality can be achieved. In addition, the component limits can be used to set the viscosity of the electrolytes in a targeted manner by varying the contents of the various polyhydric alcohols, without changing the polishing result. The viscosity can otherwise only be set by adding further auxiliary substances. This is eliminated with the present electrolyte. Another advantage of the electrolyte is high thermal resistance. This can be utilized to also carry out the electropolishing process at elevated temperatures, whereby the duration of the electropolishing process can be considerably reduced.

Another advantage can be that the materials used here are present in liquid form and easily miscible with one another. This renders the use of additional solvents obsolete.

In a preferred embodiment, the polyalcohol is glycerol. Compared to electrolytes based solely on glycols, the addition of glycerol allows the surfaces of the component to be polished to be removed substantially more uniformly, largely independently of the distance with respect to the cathode. This is in particular of advantage when a large number of workpieces having filigree structures is to be electropolished, since even "difficult-to-access" locations of the filigree structure are removed in the same manner as "easy-to-access" locations. Another advantage of glycerol is that it is comparatively inexpensive to acquire. Another advantage that has emerged here is that the use of glycerol can minimize the formation of passivated regions (so-called plateaus). The scrap rate resulting from this defect is between 5 and 10% of electropolished workpieces. This phenomenon does not occur when using glycerol.

Another significant advantage that has emerged with the use of glycerol is that successful polishing is also achieved with workpieces that have an existing oxide coating, in particular when electropolishing filigree workpieces, such as stents. Such an oxide coating generally poses an obstacle to complete electropolishing since oxide residue remains in narrow areas (such as in narrow strut curves). So as to prevent this, a removal step is generally provided upstream, such as by way of sand blasting. Such a pre-cleaning step can be dispensed with when using the present electrolyte.

The electrolyte furthermore has the advantage that all components have a very low vapor pressure, whereby only low requirements with regard to occupational health and safety are necessary.

In one embodiment, an electrolyte having the following composition is provided having:

less than or up to 12 vol % methanesulfonic acid; and
32-62 vol % of a diol; and
26-56 vol % of a triol.

In one embodiment, an electrolyte having the following composition is provided having:

less than or up to 10 vol % methanesulfonic acid; and
30-60 vol % of a diol; and
30-60 vol % of a triol.

In one embodiment, an electrolyte having the following composition is provided having:

1 to 7 vol % methanesulfonic acid; and
33-60 vol % of a diol; and
33-60 vol % of a triol.

In one embodiment, an electrolyte having the following composition is provided having:

1 to 7 vol % methanesulfonic acid; and
33-60 vol % of a diol; and
33-60 vol % glycerol, wherein the diol is selected from ethylene glycol and 1,2-propanediol.

In one embodiment, an electrolyte having the following composition is provided having:

2.5 vol % and less than 5 vol % methanesulfonic acid; and
more than 35 to 60 vol % of a diol; and
more than 35 to 60 vol % glycerol, wherein the diol is selected from ethylene glycol and 1,2-propanediol.

In one embodiment, an electrolyte having the following composition is provided having:

2.5 vol % and less than 5 vol % methanesulfonic acid; and
35-45 vol % of a diol; and
more than 50 vol % to 62.5 vol % glycerol, wherein the diol is selected from ethylene glycol and 1,2-propanediol.

In one embodiment, an electrolyte having the following composition is provided having:

2.5 vol % and less than 5 vol % methanesulfonic acid; and
more than 50 vol % to 62.5 vol % of a diol; and
35-45 vol % glycerol, wherein the diol is selected from ethylene glycol and 1,2-propanediol.

In one embodiment, an electrolyte having the following composition is provided having:

7 to 12 vol % methanesulfonic acid; and
38-63 vol % of a diol; and
25-55 vol % glycerol, wherein the diol is selected from ethylene glycol and 1,2-propanediol.

Another aspect of the present application is directed to an electropolishing method for a workpiece made of metal, and in particular made of titanium or a titanium alloy. It is also possible to electropolish other metals or alloys thereof by way of the present system. It is possible to use iron and alloys thereof as well as cobalt and alloys thereof. Another aspect of the present application is in particular an electropolishing method for stents made of nitinol, steel, or Co—Cr alloys. Such a method includes the following steps:

providing an electrolyte of the invention;
introducing a workpiece made of metal, and in particular made of titanium or a titanium alloy, into the electrolyte;
connecting the workpiece to the anode; and
applying a voltage.

The production method can be carried out best when a voltage between 5 and 100 volts is applied.

Exemplary Embodiments

Electrolyte 1:

38 vol % ethylene glycol, 57 vol % glycerol, 5%, 5 vol % methanesulfonic acid.

Electrolyte 2:

57 vol % 1,2-propanediol, 38 vol % glycerol, 5%, 5 vol % methanesulfonic acid.

Electrolyte 3:

57 vol % 1,4-propanediol, 38 vol % glycerol, 5%, 5 vol % methanesulfonic acid.

Electrolyte 4:

57 vol % polyethylene glycol 200, 38 vol % glycerol, 5%, 5 vol % methanesulfonic acid.

Electrolyte 5:

57 vol % polyethylene glycol 300, 38 vol % glycerol, 5%, 5 vol % methanesulfonic acid.

Electrolyte 6:

54 vol % 1,2-propanediol, 36 vol % glycerol, 10 vol % methanesulfonic acid.

The electrolyte was produced by combining the components and intensively mixing these. Thereafter, a voltage of 20 to 25 volts was applied between the stent to be polished and a stainless steel cathode, which was likewise immersed into the electrolyte. The process time depends on the removal and sheen to be achieved and ranges between 1 and 3 minutes.

The process can also take place galvanostatically. The incorporation of brief process breaks avoids potentially occurring gas bubbles on the surface.

What is claimed:

1. An electrolyte, comprising:

methanesulfonic acid; and more than one polyhydric alcohol, the content of methanesulfonic acid being less than 15 vol %, the polyhydric alcohols comprising at least one diol and at least one polyalcohol, wherein the at least one polyalcohol comprises more than two OH groups, wherein the at least one diol accounts for 20 to 65 vol %, and the at least one polyalcohol accounts for 20 to 65 vol %.

2. The electrolyte according to claim 1, wherein the content of methanesulfonic acid is in the range of more than 1 vol % and less than 5 vol %.

3. The electrolyte according to claim 1, wherein the diol is selected from the group consisting of 1,2-propanediol, 1,3-propanediol, ethylene glycol, 1,2-butanediol, 1,3-butanediol, 1,4-butanediol, 2,3-butanediol, 1,2-pentanediol, 1,3-pentanediol, 1,4-pentanediol, 1,5-pentanediol, 2,3-pentanediol, 2,4-pentanediol.

4. An electrolyte, comprising:

methanesulfonic acid; and more than one polyhydric alcohol, the content of methanesulfonic acid being less than 15 vol %, the polyhydric alcohols comprising at least one diol and at least one polyalcohol, wherein the at least one diol accounts for 20 to 65 vol %, and the at least one polyalcohol accounts for 20 to 65 vol %, wherein the polyalcohol is selected from the group of triols including a linear C3 to C5 carbon chain.

5. An electrolyte, comprising:

methanesulfonic acid; and more than one polyhydric alcohol, the content of methanesulfonic acid being less than 15 vol %, the polyhydric alcohols comprising at least one diol and at least one polyalcohol, wherein the at least one diol accounts for 20 to 65 vol %, and the at least one polyalcohol accounts for 20 to 65 vol %, wherein the polyalcohol is glycerol.

6. An electrolyte, comprising:

methanesulfonic acid; and more than one polyhydric alcohol, the content of methanesulfonic acid being less than 15 vol %, the polyhydric alcohols comprising at least one diol and at least one polyalcohol, wherein the at least one diol accounts for 20 to 65 vol %, and the at least one polyalcohol accounts for 20 to 65 vol %, having the following composition:

to 7 vol % methanesulfonic acid; and 33-60 vol % of a diol; and 33-60 vol % glycerol, wherein the diol is selected from ethylene glycol and 1,2-propanediol.

7. An electropolishing method for a workpiece made of metal, comprising:

providing an electrolyte according to claim 1;

introducing a workpiece made of titanium or a titanium alloy, into the electrolyte;

connecting the workpiece to an anode; and applying a voltage to the workpiece to electropolish the workpiece.

8. The electrolyte of claim 1, wherein the electrolyte consists of:

the methanesulfonic acid; and the more than one polyhydric alcohol, the content of methanesulfonic acid being less than 15 vol %, the polyhydric alcohols comprising at least one diol and at least one polyalcohol, wherein the at least one polyalcohol comprises more than two OH groups, wherein the at least one diol accounts for 20 to 65 vol %, and the at least one polyalcohol accounts for 20 to 65 vol %.

9. The electrolyte according to claim 8, wherein the content of methanesulfonic acid is in the range of more than 1 vol % and less than 5 vol %.

10. The electrolyte according to claim 8, wherein the diol is selected from the group consisting of 1,2-propanediol, 1,3-propanediol, ethylene glycol, 1,2-butanediol, 1,3-butanediol, 1,4-butanediol, 2,3-butanediol, 1,2-pentanediol, 1,3-pentanediol, 1,4-pentanediol, 1,5-pentanediol, 2,3-pentanediol, 2,4-pentanediol.

11. The electrolyte according to claim 8, wherein the polyalcohol is selected from the group of triols including a linear C3 to C5 carbon chain.

12. The electrolyte according to claim 8, wherein the polyalcohol is glycerol.

13. The electrolyte according to claim 8, having the following composition:

1 to 7 vol % methanesulfonic acid; and 33-60 vol % of a diol; and 33-60 vol % glycerol, wherein the diol is selected from ethylene glycol and 1,2-propanediol.

* * * * *